US005738893A

United States Patent [19]

Kornet et al.

[11] Patent Number: 5,738,893

[45] Date of Patent: Apr. 14, 1998

[54] METHOD OF WRAPPING TOMATOES ON-THE-VINE

[75] Inventors: Gerrit Jan Kornet, Woerden; Ferdinandus Jozef Maria Streng, Boskoop, both of Netherlands

[73] Assignee: B.V. Frugifera, Netherlands

[21] Appl. No.: 632,566

[22] Filed: Apr. 15, 1996

[51] Int. Cl.[6] ..... B65D 33/01; B65D 85/34; B65B 25/04

[52] U.S. Cl. ..... 426/413; 426/415; 426/419; 206/554; 383/103; 383/907; 53/459

[58] Field of Search ..... 426/410, 413, 426/415, 419; 206/554; 383/103, 35, 907; 53/571, 572, 459, 390; 248/95, 101

[56] References Cited

U.S. PATENT DOCUMENTS

| | | | |
|---|---|---|---|
| 383,327 | 5/1888 | Starr | 383/103 |
| 2,997,167 | 8/1961 | Westfall | 206/554 |
| 3,040,966 | 6/1962 | Crane | 383/103 |
| 3,097,787 | 7/1963 | Schur | 383/103 |
| 3,126,094 | 3/1964 | Arnold et al. | 206/554 |
| 3,245,606 | 4/1966 | Crane | 383/103 |
| 3,285,407 | 11/1966 | Abramson | 206/554 |
| 3,372,857 | 3/1968 | Brayla | 383/35 |
| 3,495,764 | 2/1970 | Crane | 383/103 |
| 3,552,637 | 1/1971 | Swinford | 383/103 |
| 3,556,389 | 1/1971 | Gregoire | 383/907 |
| 3,640,450 | 2/1972 | Lieberman | 383/35 |
| 3,771,645 | 11/1973 | Wendel | 206/554 |
| 4,106,733 | 8/1978 | Walitalo | 53/572 |
| 4,503,561 | 3/1985 | Bruno | 383/103 |
| 4,637,061 | 1/1987 | Riese | 383/35 |
| 4,698,226 | 10/1987 | Guthrie | 383/103 |
| 4,846,586 | 7/1989 | Bruno | 383/35 |
| 4,957,791 | 9/1990 | Richter | 383/103 |
| 5,405,561 | 4/1995 | Dais et al. | 383/103 |
| 5,457,944 | 10/1995 | Lipes | 53/572 |
| 5,492,705 | 2/1996 | Porchia et al. | 383/103 |

FOREIGN PATENT DOCUMENTS

| | | | |
|---|---|---|---|
| 2614899 | 10/1977 | Germany | 383/103 |
| 2802849 | 7/1978 | Germany | 383/103 |
| 4-253625 | 9/1992 | Japan | 53/572 |
| 6-191508 | 7/1994 | Japan | 53/572 |
| 7801075 | 9/1978 | Netherlands | 383/103 |
| 1073913 | 6/1967 | United Kingdom | 206/554 |

*Primary Examiner*—Steven Weinstein

*Attorney, Agent, or Firm*—Knobbe Martens Olson & Bear LLP

[57] ABSTRACT

A combination comprising a bunch of tomatoes on-the-vine contained in a closed wrapping is provided for retail sale to a consumer. The tomatoes are wrapped without detaching each tomato from a common stem and a bunch of at least about 3 substantially ripe tomatoes are kept together. The wrapping advantageously has a cone shape and air openings to accommodate the bunch of tomatoes on-the-vine. The tomatoes are shipped from the grower to the consumer without damage from handling during packing and transportation using the present wrapping and shipping boxes having a bulb-like, cushioning layer of material simulating a lower layer of tomatoes.

3 Claims, 2 Drawing Sheets

METHOD OF WRAPPING TOMATOES ON-THE-VINE

FIELD OF THE INVENTION

The present invention relates generally to containers for produce, and, in particular, to a wrapping for containing tomatoes on-the-vine.

BACKGROUND OF THE INVENTION

Consumers prefer to purchase individual items of produce according to their individual tastes, and will therefore not hesitate to pick and choose among such items of produce which are displayed loose in a bin. Thus, when apples or tomatoes displayed, the best apples or tomatoes are chosen first, and the remaining items are handled numerous times before they are bought, if they are bought at all. These open displays are attractive to the consumer, but may result in a financial loss to the seller if too many of the produce become damaged or are otherwise unsellable.

Produce are often put in bags to prevent the consumer from choosing only certain ones for purchase. In addition to preventing the "picking over" of produce described above, bagged produce can result in greater bulk sales of the produce. Apples and oranges are typical of the products sold in this manner. However, other produce not having the firmer flesh of an apple, or the tougher skin of an orange, are not good candidates for selling in bags. Tomatoes, and especially ripe tomatoes, for example, because of their tender flesh and thin skins are usually individually displayed in a produce bin. Grapes are an exception, and are often sold in bags because they are usually sold "on-the-vine" as a bunch. Individual grapes are vulnerable to falling off the vine so that too many loose grapes may be lost or fall to the bottom of the produce bin. Also, many consumers freely snack on unbagged grapes while they shop, so that sales are lost by the grapes being eaten before they are purchased. If the consumer consumes grapes sold by weight, the consumer may only pay for the proportion of the bunch of grapes which were not eaten in the store.

The bags for grapes typically comprise a plastic wrapping having a rectangular shape when laid out flat. Three sides are sealed and the fourth side is often tied in a knot to close the bag after the bunch of grapes have been inserted. Large openings are provided on the bag for ventilation of the grapes to discourage mold or fungus growth and also help the bag conform to the shape of the bunch of grapes that are contained within the bag.

Another type of produce sold in a plastic bag is chinese leaves or greens, such as bok choy. The bag comprises two sheets of plastic having a generally trapezoidal shape. To accommodate the fairly long, stiff stalk or stem of the chinese leaves, one sheet is about 18 inches in length and is sealed along its longer sides to the other sheet which is about 20 inches in length. One of the open ends of the bag is about 9½ inches wide, and the other open end is about 16 inches wide. A printed label describing the produce is provided on the side of the bag and covers a majority of the outer surface. A series of about four pairs of holes, about 5 mm in diameter, are provided along the center length of the bag, and three holes, about 10 mm in diameter, are provided laterally about the middle of the length of the bag.

A similar type of plastic bag, which is used for young plants in small pots, also has a trapezoidal shape and is sealed along its longer sides. The bag has a plurality of needle punched air openings provided along substantially its entirety. The hot needle punch technique used to make the openings results in one side of the plastic having a rough texture, and the bag is formed so that the rougher side is on the inside where the potted plant is inserted and helps to prevent slippage of the pot out of the bottom of the bag. This bag is useful to protect the young plant and also for easier placement of these potted plants into, and removal from, large trays used for shipping the plants. The individual pots do not have to be gripped at their upper edge and the plant does not have to be touched or disturbed.

SUMMARY OF THE INVENTION

In the present invention, a combination is provided comprising a bunch of tomatoes on-the-vine and its wrapping for retail sale to a consumer. The tomatoes are wrapped without detaching each tomato from a common stem and a bunch of at least about 3 substantially ripe tomatoes are kept together. The wrapping advantageously has a cone shape and air openings to accommodate the bunch of tomatoes on-the-vine. The tomatoes are shipped from the grower to the consumer without damage from handling or during transportation using the present wrapping and shipping boxes having a bulb-like, cushioning layer of material simulating a lower layer of tomatoes.

In one aspect of the invention, a combination is provided comprising a bunch of on-the-vine tomatoes contained in a plastic wrapping entirely surrounding the bunch. The bunch of tomatoes comprises at least three substantially ripe tomatoes and a stem attached to each of them, with the stem having a free end not attached to a tomato. The wrapping consists of two planar, substantially trapezoidal sheets of plastic, each having a bottom, two sides and a top. The length of the bottom is between 8 and 16 cm, and the trapezoidal sheets are heat sealed to each other along their bottom and two sides, but not along the top, thereby forming a cone-shaped wrapping having an inner side and an outer side. Each of the sheets is needle punched to provide a plurality of air openings therein. Each of the air openings has a rough side and a smooth side, with their rough sides being on the outer side of the wrapping. The openings are between about 0.5 mm and about 1.5 mm in diameter.

Preferably, the top of the wrapping is closed so that the bunch of tomatoes are inaccessible to the consumer, so he or she cannot take only selected tomatoes out of the wrapping for purchase. The air openings of the sheets of the wrapping are preferably hot needle punched to form a geometric pattern substantially covering each of the sheets. Optionally, one of the sheets of the wrapping has a portion without air openings to accommodate a label identifying its contents.

It is preferred that the sheets of the wrapping be substantially the same size, with the length of the wrapping between about 35 and 55 cm, and the angle formed by each side with the bottom being between about 70°–90°. The plastic sheets are preferably cast polypropylene and have a thickness of about 0.030 mm. In addition, it is preferred that the bottoms of the sheets extend past their heat seal to form a tab. A perforation at the bottom of the wrapping is preferably provided for attachment of the tab.

In another aspect of the present invention, a preferred method of wrapping a bunch of tomatoes on-the-vine comprises a) providing a plurality of containers, b) stapling the containers together at tabs formed on their ends such that an individual container may be removed from rest by tearing it off at its perforation, c) arranging the containers temporarily onto a holder with their tab ends hanging freely, d) inserting a bunch of tomatoes on-the-vine into a first container with the free end of its stem is near the top of the container, and e) removing the container from the holder and tearing along its perforation to separate the container from the remaining containers. Each of the containers is formed by a pair of plastic sheets having substantially a cone shape and sized substantially the same. The sheets each have a bottom, two sides and a top, and a plurality of air openings formed thereon. The bottoms and sides of each pair of sheets are heat sealed together, and the bottoms of the sheets form tabs extending beyond the heat seal. Perforations are provided below the heat seal and separate the tabs from the remainder of the container.

Preferably, the method comprises step f) providing a closure at the top of the first container. Further, the method preferably comprises repeating steps d)–f) for successive containers on the holder and additional bunches of tomatoes.

In another aspect of the present invention, a preferred method of packing bunches of wrapped tomatoes on-the-vine for shipping from a grower comprises the steps of i) wrapping each of the bunches of tomatoes in a container, ii) providing a box having an open top, iii) providing a cushioning layer in the box on its bottom, and iv) placing the bunches of tomatoes on the cushioning layer within the box to form substantially a single layer of tomatoes separated by the plastic sheets of their containers. Each container is formed by a pair of plastic sheets having substantially a trapezoidal or cone shape and substantially the same size. The pairs of sheets have a bottom, two sides and a top, with a plurality of air openings provided thereon, and with the bottoms and sides of each pair heat sealed together. A closure is provided at the top of each container. The cushioning layer has a plurality of spaced rounded protrusions approximately the same size as the tomatoes, and the box is preferably sized so that the level of tomatoes contained therein does not extend past an upper edge of the box. Preferably, the method also comprises stacking a plurality of these boxes containing the bunches of tomatoes one atop the other for shipping.

Further advantages and applications will become apparent to those skilled in the art from the following detailed description and the drawings referenced herein.

DETAILED DESCRIPTION OF THE PREFERRED EMBODIMENT

Figure 1:
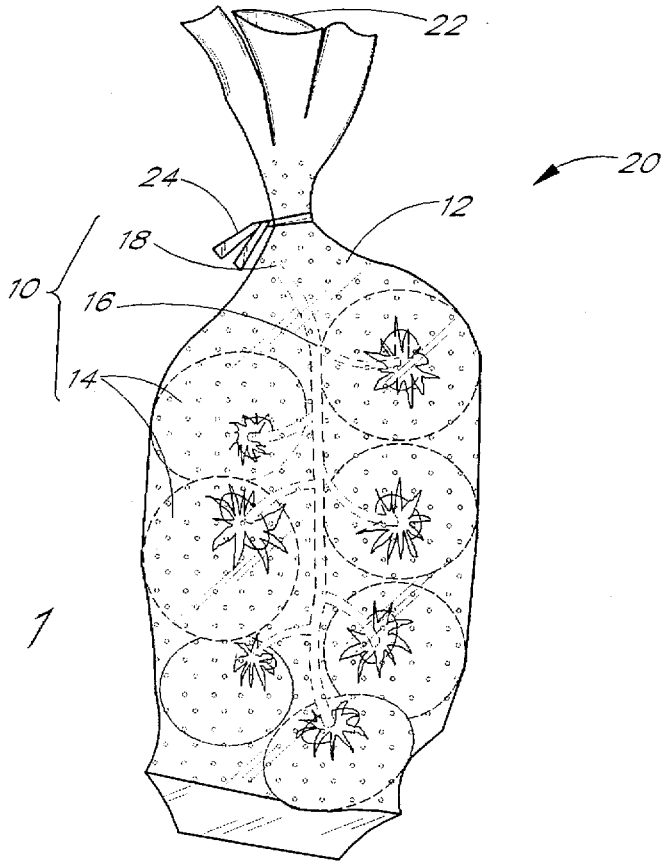
FIG. 1 is a perspective view of a bunch of tomatoes on-the-vine contained in a wrapping in a preferred embodiment of the present invention, illustrating the use of a closure at the top to prevent access by consumers to remove selected tomatoes from the bunch.

A combination of the present invention of a bunch of tomatoes on-the-vine 10 and a wrapping 12 therefor are shown in a preferred embodiment in FIG. 1, and generally referenced by the numeral 20. The bunch of tomatoes 10 preferably comprises at least three, and more preferably about six, substantially ripe tomatoes 14. Of course, any number of tomatoes can be in the bunch 10, according to their production by the tomato plant.

For tomatoes-on-the-vine, part of the appeal of the product lies in the sale of the tomatoes in a bunch while still attached to the vine. Thus, preferably, the top of the wrapping 12 is closed so that the bunch of tomatoes 10 are inaccessible to the consumer, so he or she cannot take only selected tomatoes 14 out of the wrapping for purchase. A stem or vine 16 connects each of the tomatoes 14 and has a free end 18 which is not attached to a tomato 14. Within the wrapping 12, the tomatoes 14 are aligned to substantially form a single layer generally following the outer shape of the wrapping 12, shown in FIG. 2. Preferably, the greenest or youngest of the tomatoes is near the bottom of the wrapping 12. The stem 16 is positioned near a top 22 of the wrapping which is preferably closed using a twist tie, tape or other closure 24 known to those skilled in the art. A closure, such as tape, which is not readily re-closeable by the consumer is preferred so that consumers cannot open and reclose the bag while still in the store.

Figure 2:
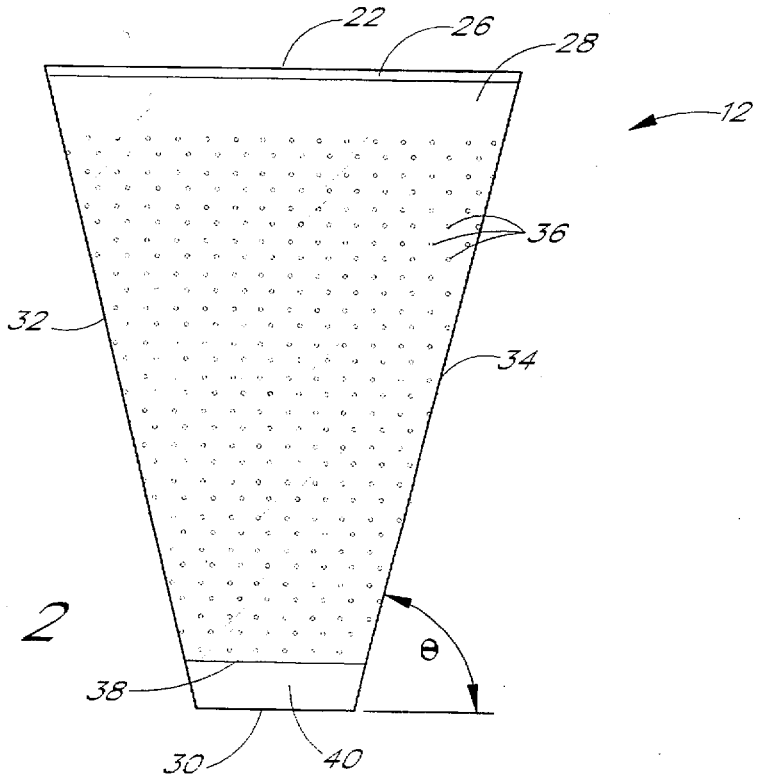
FIG. 2 is a plan view of the wrapping of FIG. 1, illustrating the substantially cone-shaped sheets of plastic and the air openings provided thereon.

Referring to FIG. 2, the wrapping 12 consists of two planar, substantially trapezoidal sheets of plastic 26, 28, each having a bottom 30, two sides 32, 34 and a top 22. In a preferred embodiment, the length of the wrapping 12 is between about 35 and 55 cm. An angle θ is formed by each side 32, 34 with the bottom 30, which is preferably between about 70°–90°. The plastic sheets 26, 28 can be of any food grade plastic, but, are preferably cast polypropylene and have a thickness of about 0.030 mm. Optionally, one sheet 26 may be longer than the other to facilitate separation of the two sheets 26, 28 during the insertion of the bunch of tomatoes 10, described below. The length of the bottom 30 between the two sides 32, 34 is between about 8 and 16 cm, and the trapezoidal sheets 26, 28 are heat sealed to each other along their bottom 30 and two sides 32, 34, but not along their top 22, thereby forming a cone-shaped wrapping 12 having an inner side and an outer side. Alternatively, the shape of the wrapping 12 may be substantially rectangular.

Each of the sheets 26, 28 is needle punched to provide a plurality of air openings 36 therein. Each of the air openings 36 has a rough side and a smooth side, with their rough sides being on the outer side of the wrapping 12. The openings 36 are between about 0.5 mm and about 1.5 mm in diameter. The air openings 36 of the sheets 26, 28 of the wrapping 12 are preferably hot needle punched to form a geometric pattern substantially covering each of the sheets 26, 28. Optionally, one of the sheets 26, 28 of the wrapping 12 has a portion without air openings to accommodate a label (not shown) identifying its contents. The label can be printed directly onto the plastic sheet 26, 28 using methods known to those skilled in the art.

Figure 3:
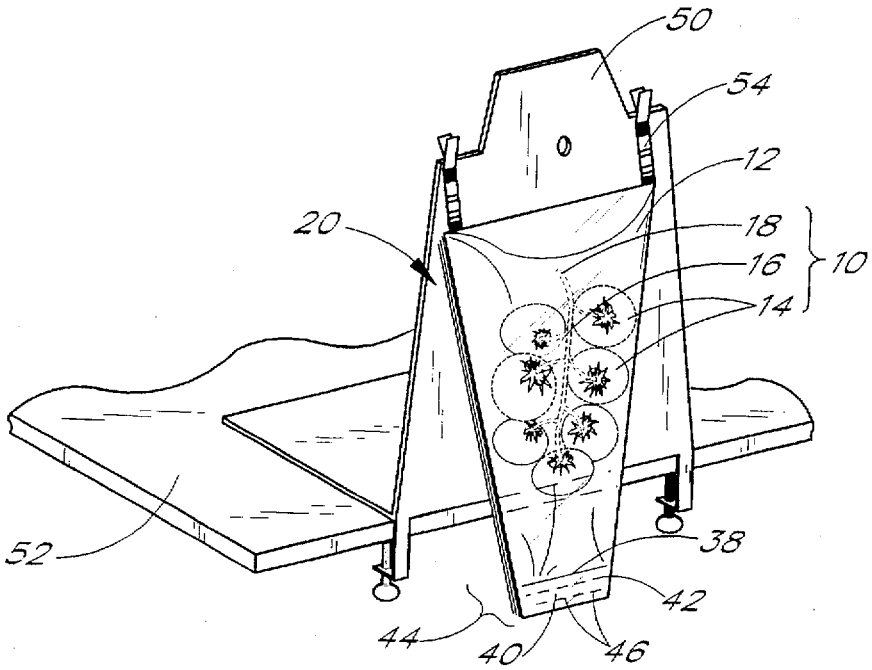
FIG. 3 is a perspective view of a preferred method of inserting the bunch of tomatoes on-the-vine into the wrapping in the present invention.

As discussed above, the sheets 26, 28 of the wrapping 12 can be substantially the same size. However, as shown in FIG. 2, it is preferred that the lower end of at least one of the sheets 26, 28 extend past the heat seal 38 to form a tab 40. As shown in FIG. 3, a perforation 42 at the bottom of the wrapping 12 is preferably provided for removable attachment of the tab 40. The perforation 42 allows a plurality of the wrappings 44 to be attached together at their tabs 40 by staples 46. This group of wrappings 44 are then provided to a grower for wrapping the tomatoes 14 immediately after harvesting from the plants. The wrapped tomatoes 20 are then shipped to retailers preferably using packing boxes 48 as described below.

Referring to FIG. 3, a preferred method of wrapping a bunch of tomatoes on-the-vine 10 comprises a) providing a plurality of wrappings or containers 44, b) stapling the containers together at tabs 40 formed on their ends such that an individual container 12 may be removed from rest by tearing it off at its perforation 42, c) arranging the containers 44 temporarily onto a holder 50 with their tab ends hanging freely, d) inserting a bunch of tomatoes on-the-vine 10 into a first container 12 with the free end 18 of its stem 16 is near the top of the container 12, and e) removing the container 12 from the holder 50 and tearing along its perforation 42 to separate the container 12 from the remaining containers. Preferably, the method also comprises the step f) of providing a closure 24 at the top of the first container 12. Further, the method preferably comprises repeating steps d)–f) for successive containers on the holder 50 and additional bunches of tomatoes as necessary.

Each of the containers 12 is formed by a pair of plastic sheets 26, 28 having substantially a cone shape and sized substantially the same. The sheets 26, 28 each have a bottom 30, two sides 32, 34 and a top 22, and a plurality of air openings 36 formed thereon. The bottoms 30 and sides 32, 34 of each pair of sheets 26, 28 are heat sealed together, and the bottoms 30 of the sheets 26, 28 form tabs 40 extending beyond a heat seal 38. Perforations 42 are provided below the heat seal 38 and separate the tabs 40 from the remainder of the container 12.

The holder 50 attaches to a table 52 or other support, or it may be free-standing for use in the fields near the tomato plants. Clips 54 or other temporary fasteners are used to hold the upper ends of the wrappings 44 onto the holder 50 during the wrapping of the many bunches of tomatoes on-the-vine.

Figure 4:
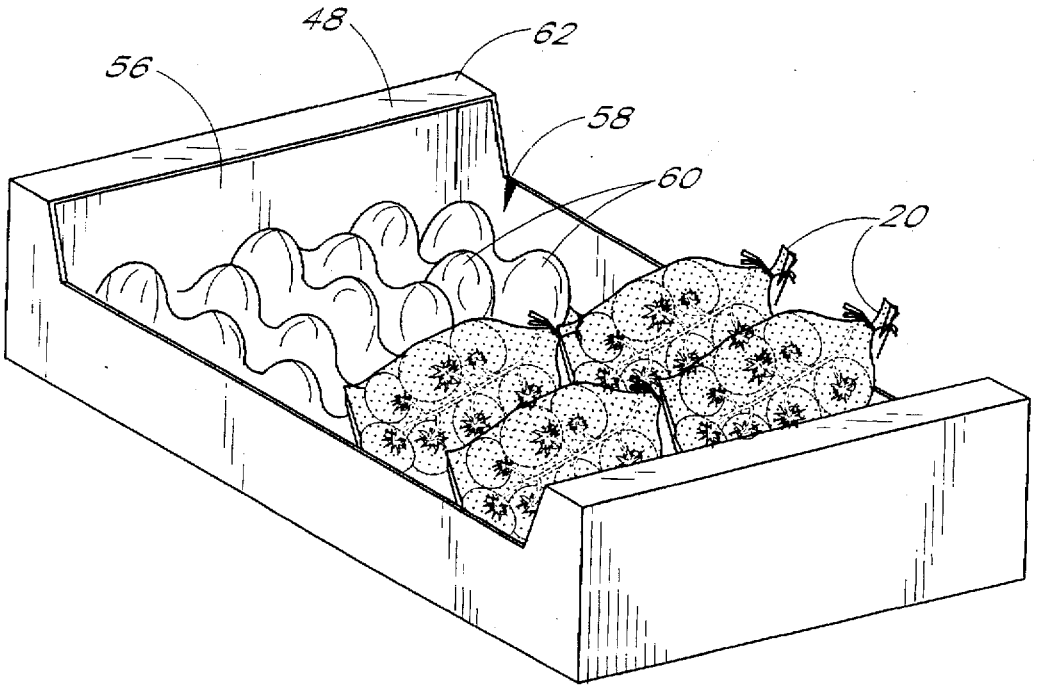
FIG. 4 is a perspective view of a preferred method of transporting the wrapped bunch of tomatoes on-the-vine, illustrating the use of a cushioning layer simulating a lower layer of tomatoes in an open top box.

Referring to FIG. 4, a preferred method of packing bunches of wrapped tomatoes on-the-vine 20 for shipping from a grower to a retailer comprises the steps of i) wrapping each of the bunches of tomatoes 10 in a wrapping or container 12, ii) providing a box 48 having an open top 56, iii) providing a cushioning layer 58 in the box 48 on its bottom, and iv) placing the wrapped bunches of tomatoes 20 on the cushioning layer 58 within the box 48 to form substantially a single layer of tomatoes 14 separated by the plastic sheets 26, 28 of their containers 12. Each container 12 is formed by a pair of plastic sheets 26, 28 having substantially a cone shape and substantially the same size. The pairs of sheets have a bottom 30, two sides 32, 34 and a top 22, with a plurality of air openings 36 provided thereon, and with the bottoms 30 and sides 32, 34 of each pair heat sealed together. A closure 24 is provided at the top 22 of each container 12. The cushioning layer 58 has a plurality of spaced rounded protrusions 60 approximately the same size as the tomatoes 14, and the box 48 is preferably sized so that the level of tomatoes contained therein does not extend past an upper edge 62 of the box 48. Preferably, the method also comprises stacking a plurality of these boxes 48 containing the wrapped bunches of tomatoes 20 one atop the other for shipping.

Thus, the present invention provides a novel combination of a wrapping containing tomatoes on-the-vine. The ripe tomatoes are able to be handled and shipped to a retailer with minimal adverse effect to the tomatoes. The retailer is assured of the sales of substantially all of the tomatoes without individual ones being picked off the vine and taken by picky shoppers. In a method of the present invention, a plurality of the wrappings are provided to the grower for use with a holder that facilitates easy wrapping of the tomatoes on-the-vine. In another method of the present invention, the wrapped tomatoes are packed in a manner that minimizes damage to the ripe tomatoes during transportation to the various retail locations.

The embodiments illustrated and described above are provided merely as examples of the wrapping containing tomatoes on-the-vine of the present invention. Other changes and modifications can be made from the embodiments presented herein by those skilled in the art without departure from the spirit and scope of the invention, as defined by the appended claims.

What is claimed is:

1. A method of wrapping a bunch of tomatoes on-the-vine, said bunch comprising at least three substantially ripe tomatoes and a stem attached to each of said tomatoes, said stem having a free end not attached to a tomato, said method comprising:

(a) providing a plurality of containers, each of said containers formed by a pair of plastic sheets having substantially a trapezoidal shape, said pair of sheets each having a bottom, two sides and a top, said bottoms and sides of said pair of sheets heat sealed together, a plurality of air openings provided on said pair of sheets, said bottom of at least one of said sheets forming tabs extending beyond said heat seals, said tabs having perforations formed thereon;

(b) stapling said plurality of containers together at said tabs such that an individual container may be removed from said plurality of containers by tearing it off at its perforation;

(c) arranging said plurality of containers onto a holder such that said containers are temporarily secured to said holder at said top of each of said containers and said tabs of said containers hang freely;

(d) inserting said bunch of tomatoes into a first container such that said free end of said stem is near the top of said first container; and (e) removing said first container from said holder and tearing along its perforation to separate said first container from the remaining containers.

2. The method of claim 1, further comprising the following step:

(f) providing a closure at said top of said first container.

3. The method of claim 2, further comprising repeating steps (d)–(f) for successive containers on said holder and additional bunches of tomatoes.

* * * * *